US006595287B2

(12) United States Patent
Fisher

(10) Patent No.: US 6,595,287 B2
(45) Date of Patent: Jul. 22, 2003

(54) AUTO ADJUSTING WELL CONTROL SYSTEM AND METHOD

(75) Inventor: Danny Fisher, Yukon, OK (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 09/972,390

(22) Filed: Oct. 5, 2001

(65) Prior Publication Data

US 2002/0074118 A1 Jun. 20, 2002

Related U.S. Application Data

(60) Provisional application No. 60/238,496, filed on Oct. 6, 2000.

(51) Int. Cl.[7] ..... E21B 43/12; E21B 47/06

(52) U.S. Cl. ..... 166/250.15; 166/372; 166/263

(58) Field of Search ..... 166/250.15, 372, 166/263, 53

(56) References Cited

U.S. PATENT DOCUMENTS 3,266,574 A * 8/1966 Gandy ..... 166/53
3,396,793 A * 8/1968 Piper et al. ..... 166/53

(List continued on next page.)

FOREIGN PATENT DOCUMENTS

| | | | |
|---|---|---|---|
| EP | 668492 A2 * | 8/1995 | ..... G01M/3/26 |
| WO | WO 97/16624 | 5/1997 | ..... E21B/34/16 |
| WO | WO 97/46793 | 12/1997 | ..... E21B/47/10 |

OTHER PUBLICATIONS

International Search Report, International Application No. PCT/GB 01/00778, dated Aug. 13, 2001.

PCT International Search Report from International Application No. PCT/GB01/04488, Dated Apr. 16, 2002.

*Primary Examiner*—David Bagnell
*Assistant Examiner*—Shane Bomar
(74) *Attorney, Agent, or Firm*—Moser, Patterson & Sheridan, L.L.P.

(57) ABSTRACT

A programmable controller for operating an artificial lift well is provided to monitor and operate a variety of analog and digital devices. An on-cycle of the well is initiated based on a pressure differential measured between a casing pressure and a sales line pressure. When a predetermined ON pressure differential is observed, the controller initiates the on-cycle and open a motor valve to permit fluid and gas accumulated in the tubing to eurged out of the well. Thereafter, the controller initiates a mandatory flow period and maintains the motor valve open for a period of time. The valve remains open as the system transitions into the sales time period. During sales time, the controller monitors the gas flow through an orifice disposed in the sales line. A differential pressure transducer is used to measure a pressure differential across the orifice. When the measure pressure differential is less than or equal to a predetermined OFF pressure differential, the controller initiates the off cycle. The off cycle starts with a mandatory shut-in period to a low the plunger to fall back into the well. Thereafter, the well remains in the off-cycle until the controller receives a signal that the ON pressure differential has developed. In another aspect, the controller may adjust the operating parameters of the well based on the completion of the cycle.

60 Claims, 3 Drawing Sheets

U.S. PATENT DOCUMENTS

| | | | | | |
|---|---|---|---|---|---|
| 3,678,997 | A | * | 7/1972 | Barchard | 166/53 |
| 3,863,714 | A | | 2/1975 | Watson, Jr. | 166/53 |
| 4,461,172 | A | | 7/1984 | McKee et al. | 73/155 |
| 4,921,048 | A | | 5/1990 | Crow et al. | 166/372 |
| 4,989,671 | A | * | 2/1991 | Lamp | 166/53 |
| 5,132,904 | A | | 7/1992 | Lamp | 364/422 |
| 5,146,991 | A | | 9/1992 | Rogers, Jr. | 166/369 |
| RE34,111 | E | * | 10/1992 | Wynn | 166/53 |
| 5,314,016 | A | | 5/1994 | Dunham | 166/250 |
| 5,517,593 | A | | 5/1996 | Nenniger et al. | 392/301 |
| 5,622,223 | A | | 4/1997 | Vasquez | 166/264 |
| 5,634,522 | A | | 6/1997 | Hershberger | 166/372 |
| 5,636,693 | A | * | 6/1997 | Elmer | 166/370 |
| 5,735,346 | A | * | 4/1998 | Brewer | 166/250.03 |
| 5,873,411 | A | | 2/1999 | Prentiss | 166/105 |
| 5,878,817 | A | * | 3/1999 | Stastka | 166/372 |
| 5,941,305 | A | | 8/1999 | Thrasher et al. | 166/53 |
| 5,957,200 | A | | 9/1999 | Majek et al. | 166/250.15 |
| 5,984,013 | A | | 11/1999 | Giacomino et al. | 166/373 |
| 5,996,691 | A | | 12/1999 | Norris et al. | 166/250.03 |
| 6,196,324 | B1 | * | 3/2001 | Giacomino et al. | 166/372 |
| 6,241,014 | B1 | | 6/2001 | Majek et al. | 166/53 |
| 6,293,341 | B1 | * | 9/2001 | Lemetayer | 166/250.15 |

* cited by examiner

AUTO ADJUSTING WELL CONTROL SYSTEM AND METHOD

CROSS-REFERENCE TO RELATED APPLICATIONS

This application claims benefit of U.S. provisional patent application serial No. 60/238,496, filed Oct. 6, 2000, which is herein incorporated by reference.

BACKGROUND OF THE INVENTION

1. Field of the Invention

The present invention generally relates to optimizing production of hydrocarbon wells. More particularly, the invention relates to an auto-adjusting well control system for the operation of the well. More particularly still, the invention relates to optimizing the production of a hydrocarbon well intermitted by a plunger lift system or a gas lift system.

2. Description of the Related Art

The production of fluid hydrocarbons from wells involves technologies that vary depending upon the characteristics of the well. While some wells are capable of producing under naturally induced reservoir pressures, more common are wells, which employ some form of an artificial lift production procedure. During the life of any producing well, the natural reservoir pressure decreases as gases and liquids are removed from the formation. As the natural downhole pressure of a well decreases, the wellbore tends to fill up with liquids, such as oil and water. In a gas well, the accumulated fluids block the flow of the formation gas into the borehole and reduce the output production from the well. To combat this condition, artificial lift techniques are used to periodically remove the accumulated liquids from these wells. The artificial lift techniques may include plunger lift devices and gas lift devices.

Plunger lift production systems include the use of a small cylindrical plunger which travels through tubing extending from a location adjacent the producing formation in the borehole to surface equipment located at the open end of the borehole. In general, fluids which collect in the borehole and inhibit the flow of fluids out of the formation and into the well bore, are collected in the tubing. Periodically, the end of the tubing located at the surface is opened via a valve and the accumulated reservoir pressure is sufficient to force the plunger up the tubing. The plunger carries with it to the surface a load of accumulated fluids which are ejected out the top of the well. In the case of an oil well, the ejected fluids are collected as the production flow of the well. In the case of a gas well, the ejected fluids are simply disposed of, thereby allowing gas to flow more freely from the formation into the well bore and be delivered into a gas distribution system known as a sales line at the surface. The production system is operated so that after the flow of gas from the well has again become restricted due to the further accumulation of fluid downhole, the valve is closed so that the plunger falls back down the tubing. Thereafter, the plunger is ready to lift another load of fluids to the surface upon the re-opening of the valve.

A gas lift production system is another type of artificial lift system used to increase a well's performance. The gas lift production system generally includes a valve system for controlling the injection of pressurized gas from a source external to the well, such as a compressor, into the borehole. The increased pressure from the injected gas forces accumulated formation fluid up a central tubing extending along the borehole to remove the fluids as production flow or to clear the fluids and restore the free flow of gas from the formation into the well. The gas lift production system may be combined with the plunger lift system to increase efficiency and combat problems associated with liquid fall back.

The use of artificial lift systems results in the cyclical production of the well. This process, also generally termed as "intermitting," involves cycling the system between an on-cycle and an off-cycle. During the off-cycle, the well is "shut-in" and not productive. Thus, it is desirable to maintain the well in the on-cycle for as long as possible in order to fully realize the well's production capacity.

Historically, the intermitting process is controlled by pre-selected time periods. The timing technique provides for cycling the well between on and off cycles for a predetermined period of time. Deriving the time interval of these cycles has always been difficult because production parameters considered for this task are different in every well and the parameters associated with a single well change over time. For instance, as the production parameters change, a plunger lift system operating on a short timed cycle may lead to an excessive quantity of liquids within the tubing string, a condition generally referred to as a "loading up" of the well. This condition usually occurs when the system initiates the on-cycle and attempts to raise the plunger to the surface before a sufficient pressure differential has developed. Without sufficient pressure to bring it to the surface, the plunger falls back to the bottom of the wellbore without clearing the fluid thereabove. Thereafter, the cycle starts over and more fluids collect above the plunger. By the time the system initiates the on-cycle again, too much fluid has accumulated above the plunger and the pressure in the well is no longer able to raise the plunger. This condition causes the well to shut-in and represents a failure that may be quite expensive to correct.

In contrast, a lift system that operates on a relatively long timed cycle may result in waste of production capacity. The longer cycle reduces the number of trips the plunger goes to the surface. Because production is directly related to the plunger trips, production also decrease when the plunger trips decrease. Thus, it is desirable to allow the plunger to remain at the bottom only long enough to develop sufficient pressure differential to raise the plunger to the surface.

Improvements to the timing technique include changing the predetermined time period in response to the well's performance. For example, U.S. Pat. No. 4,921,048, incorporated herein by reference, discloses providing an electronic controller which detects the arrival of a plunger at the well head and monitors the time required for the plunger to make each particular round trip to the surface. The controller periodically changes the time during which the well is shut in to maximize production from the well. Similarly, in U.S. Pat. No. 5,146,991, incorporated herein by reference, the speed at which the plunger arrives at the well head is monitored. Based on the speed detected, changes may be made to the off-cycle time to optimize well production.

The forgoing arrangements, while representing an improvement in operating plunger lift wells, still fail to take into account some variables that change during the short term operation of a well. For example, the successful operation of the plunger lift well requires the on-cycle to begin when an ideal pressure differential exists between the casing pressure and the sales line pressure. However, the above optimization schemes operate solely on set time intervals and not directly upon a pressure differential.

Therefore, the controller may initiate the on-cycle before the optimal pressure differential has developed. Alternatively, the controller may prematurely end the on-cycle even though production gas flow is still viable. Furthermore, sales lines pressure fluctuations affect the optimal time to commence the on cycle. A fluctuating sales line pressure will cause a change in the effective pressure available to lift liquid out of the well. Simple self-adjusting timed cycle does not take this variable into account when adjusting the length of the cycle.

There is a need therefore, for a well control apparatus and method that uses an automated controller to monitor and adjust well components based upon a variety of factors other than time. There is a further need for an automated controller that directly utilizes variables including the sales line pressure and fluctuations thereof. There is a further need for methods and apparatus for automated control of a plunger lift well whereby operating efficiency over time can be measured and adjustments made based upon a variety of factors, including the flow rate of gas from the well over some period of time.

SUMMARY OF THE INVENTION

The present invention generally relates to an automated method and apparatus for operating an artificial lift well. In one aspect of the present invention, a programmable controller monitors and operates a variety of analog and digital devices. An on-cycle of the well is initiated based on a pressure differential measured between a casing pressure and a sales line pressure. When a predetermined ON pressure differential is observed, the controller initiates the on-cycle and open a motor valve to permit fluid and gas accumulated in the tubing to be urged out of the well. Thereafter, the controller initiates a mandatory flow period and maintains the motor valve open for a period of time. The valve remains open as the system transitions into the sales time period. During sales time, the controller monitors the gas flow through an orifice disposed in the sales line. A differential pressure transducer is used to measure a pressure differential across the orifice. When the measure pressure differential is less than or equal to a predetermined OFF pressure differential, the controller initiates the off cycle. The off cycle starts with a mandatory shut-in period to allow the plunger to fall back into the well. Thereafter, the well remains in the off-cycle until the controller receives a signal that the ON pressure differential has developed.

In another aspect of the present invention, the controller may automatically adjust the operating parameters. After a successful cycle, the controller may decrease the predetermined ON pressure differential, increase the mandatory flow period, and/or decrease the predetermined OFF pressure differential to optimize the well's production. Additionally, adjustments may be performed if the well is shut-in before a cycle is completed.

BRIEF DESCRIPTION OF THE DRAWINGS

So that the manner in which the above recited features of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Plunger Lift System

Figure 1:
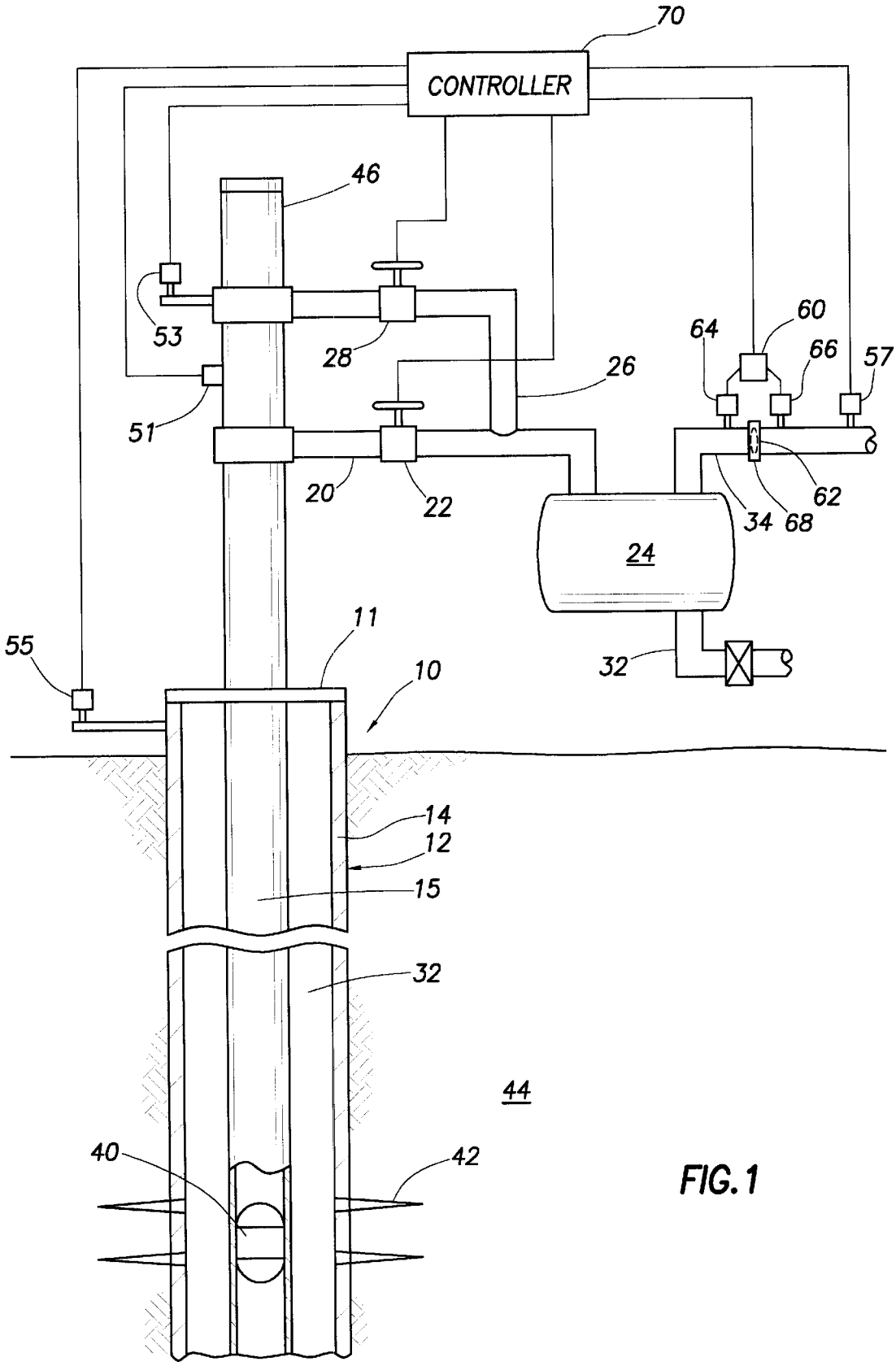
FIG. 1 is a schematic drawing of a plunger lift system.

FIG. 1 is a schematic view of aspects of the present invention applied to a plunger lift system 8. The well 10 includes a wellbore 12 which is lined with casing 14 and a string of production tubing 15 co-axially disposed therein. Perforations 42 are formed in the casing 14 for fluid communication with an adjacent formation 44. The production tubing 15 and casing 14 extend from a well head 11 located at the surface to the bottom of the well 10. A plunger 40 is disposed at the bottom of the tubing 15 when the system 8 is shut-in. A lubricator 46 for receiving the plunger 40 is disposed at the top of the tubing 15. The lubricator 46 includes a plunger arrival sensor 51 for detecting the presence of a plunger 40 and a tubing pressure transducer 53 to monitor the pressure in the tubing 15. The casing pressure, which is the pressure in an annular area 32 defined by the exterior of the tubing 15 and the interior of the casing 14, is monitored by a casing pressure transducer 55 disposed adjacent the well head 11.

A first delivery line 26 having a motor valve 28 connects an upper end of the tubing 15 to a separator 24. The separator 24 separates liquid and gas from the tubing string 15. Liquid exits the separator 24 through a line 32 leading to a tank (not shown), and gas exits the separator 24 through a sales line 34. A second delivery line 20 having a well head valve 22 connects the upper end of the tubing 15 to the first delivery line 26 at a position between the motor valve 28 and the separator 24. The pressure in the sales line 34 is monitored by a sales line pressure transducer 57. A pressure differential transducer 60 and a plate 68 having an orifice 62 therein are disposed on the sales line 34 to monitor the gas flow across the orifice 62. Specifically, pressure sensors 64, 66 are placed before and after the orifice 62, and their signals are transmitted to the pressure differential transducer 60, where a pressure differential across the orifice 62 is calculated. A controller 70 receives the measured pressure differential as inputs from the pressure differential transducer 60 and responds to the inputs according to the aspects of the present invention.

In operation, the plunger lift system 8 is in the off-cycle with the plunger 40 disposed at the bottom of the well 10 and the motor valve 28 closed. During this time, also known as the "off-time," the casing pressure increases as a result of an inflow of gases and fluids from the formation 44 to the wellbore 12 through perforations 42 in the casing 14. The well 10 remains in off-time until a pre-selected "ON" pressure differential exists between the casing pressure and the sales line pressure. Preferably, the pre-selected ON pressure differential is sufficient to raise the plunger 40 along with the accumulated fluids to the surface. Using signals from the casing pressure transducer 55 and the sales pressure transducer 57, the controller 70 calculates the pressure differential between the casing pressure and the sales pressure. When the ON pressure differential is reached, the controller 70 initiates the on-cycle, or "on time."

In the on time mode, the controller 70 opens the motor valve 28 to expose and reduce the tubing pressure to the sales line pressure. Reducing the tubing pressure unlocks the pressure differential between the sales line pressure and the casing pressure. The pressure differential urges the plunger 40 upward in the tubing 15 and transports a column of fluid thereabove to the well head 11.

Following an on time period, the controller 70 looks for an indication, also known as a "closed contact switch," to initiate a differential time delay to allow for a mandatory flow period as will be more fully described herein. In one embodiment, the closed contact switch sought by the controller 70 may be a drop in the casing pressure to indicate that the plunger has been lifted. Alternatively, the controller may seek a signal from the plunger arrival sensor 51 to indicate that the plunger 40 has successfully arrived at the surface within a first time period. If the plunger 40 is detected during this first time period, the controller 70 will initiate the mandatory flow period. If the plunger 40 is not detected within this first time period, the controller 70 will continue to look for the closed contact switch within a second time period.

During the second time period, the controller 70 may make adjustments to the wellbore 12 conditions to facilitate the plunger's 40 upward progress in the tubing 15. For example, the controller 70 may be programmed to open a vent valve (not shown) to reduce the tubing pressure in order to decrease the resistance against the plunger's 40 upward movement. Because the movement of the plunger 40 is related to the pressure differential, it may be possible that the plunger 40 fails to reach the surface within the first time period because the wellhead pressure is too high. Therefore, when the controller 70 does not receive an indication that the plunger 40 successfully reached the surface within the first time period, the controller 70 will open the vent valve to facilitate the plunger's 40 ascent. If the plunger 40 is detected during this second time period, the controller 70 will initiate the mandatory flow period and close the vent valve. However, if the plunger 40 fails to reach the surface during this second time period, the controller 70 will shut-in the well 10 and re-enter the off time mode.

The mandatory flow period, or differential time delay period, provides a safeguard against loading up the well 10. As described above, loading up occurs when too much fluid has accumulated above the plunger 40 and the maximum natural pressure differential is not able to move the plunger 40 and the fluid collected up the tubing 15. During the mandatory flow period, the controller 70 is programmed to ignore a reading from the pressure differential transducer 60 at the sales line 34 that would normally trigger the controller 70 to shut-in the well 10. As a result, the motor valve 28 remains open to ensure that some of the fluids are removed from the tubing 15 before the plunger 40 falls back to the bottom and collects more fluid. At the expiration of the mandatory flow period, the controller 70 initiates a sales time period.

Sales time period is the phase in the cycle when production gas is allowed to flow from the well 10 to the sales line 34. The gas flow through the sales line 34 is monitored to determine the end of the on-cycle. Specifically, the gas flow is measured by the pressure differential transducer 60 as the gas travels through the plate 68 in the sales line 34. The measured pressure differential is indicative of the gas flow in the sales line and, therefore, the well production rate.

A predetermined "OFF" pressure differential is preprogrammed into the controller 70 as the threshold production rate at which the well 10 will remain in the on-cycle. At the start of the on-cycle, a sufficient amount of gas passes through the pressure differential transducer 60 and results in a large pressure differential. When the measured pressure differential is above the OFF pressure differential, the well 10 is producing above the threshold production rate, and the controller 70 permits the motor valve 28 to remain open. As the well starts to load with liquid, the gas flow across the pressure differential transducer 60 decreases and the measured pressure differential also decreases. When the measured pressure differential is below the OFF pressure differential, the controller 70 will close the motor valve 28 and shut-in the well 10.

After the well 10 is shut-in, the controller 70 initiates a mandatory shut-in period, also known as the plunger fall time. The mandatory shut-in period provides a period of time for the plunger 40 to fall back down the tubing 15 and collect more fluid before the on-cycle is initiated. During the mandatory shut-in period, the controller 70 is programmed to not recognize an ON pressure differential reading and maintain the well 10 in the shut-in mode as the plunger 40 falls back. Once the mandatory shut-in period expires, the controller 70 will begin looking for the ON pressure differential and start a subsequent cycle.

If the system 8 successfully completes a cycle, the controller 70 will automatically adjust the parameters of the system 8 to optimize the production. Generally, the controller 70 will adjust the parameters so that the plunger 40 will stay at the bottom for a shorter period of time and the sales line 34 will remain open for a longer period of time. In one embodiment, the controller 70 will decrease the predetermined ON pressure differential for the subsequent cycle by about 10%. As a result, less time is required for the well 10 to develop the reduced ON pressure differential and trigger the on-time mode. Additionally, the differential time delay may be increased by about 10%. The adjustment to the differential time delay will allow the controller 70 to ignore any shut-in readings and keep the motor valve 28 open for a longer period of time. Furthermore, the predetermined OFF pressure differential may be lowered by about 10%. The reduction will allow the production to flow longer before the controller 70 shuts-in the well 10.

Adjustments may also be made if the well 10 does not successfully complete the cycle before shutting-in. As described above, the controller 70 will shut-in the well 10 if the differential time delay is not initiated before the expiration of the prescribed time periods for detecting the plunger 40 arrival. If this occurs, the controller 70 will automatically adjust the parameters of the cycle to ensure that the plunger 40 will reach the surface during the subsequent cycle. In one embodiment, the controller 70 will increase the predetermined ON pressure differential by about 10% in order to provide more force to raise the plunger 40 up the tubing. Also, the differential time delay may be decreased by about 10% and the predetermined OFF differential pressure may be increased by about 10%. In general, these adjustments will increase the probability that the plunger 40 will reach the surface in the subsequent cycle.

Furthermore, the controller 70 may adjust the parameters if the OFF pressure differential is met at the expiration of the differential time delay. This situation is not desirable because the controller 70 bypasses the sales time period and shuts-in the well 10 immediately after the differential time delay period. To avoid this situation, the controller 70 decreases the differential time delay and increases the predetermined OFF pressure differential by about 10% each. These adjustments will allow for some sales time period and make the well 10 more productive.

According to the aspects of the present invention, the on cycle and the off cycle may be initiated by a single measured point or from the differential between two measured points that are relevant in optimizing the well performance. In the plunger case described above, the on-cycle is initiated based on a pressure differential between the casing pressure and the sales line pressure. However, the controller 70 may be programmed to initiate the on-cycle based on a pressure differential between the casing pressure and the tubing pressure or a pressure differential between the tubing pressure and the sales line pressure. Also, the controller 70 may be programmed to initiate the on-cycle when the casing pressure reaches a specified pressure value.

The aspects of the present invention are advantageous in that the production cycle is controlled by the parameters that affect the production of the well 10. Specifically, the well 10 enters the on time mode only when a beneficial casing pressure and sales line pressure differential is reached. In this respect, the plunger 40 is accorded a higher probability that it will reach the lubricator and deliver the fluid and gases. Thereafter, the well 10 continues to produce sales flow until the production gas flow drops below a predetermined threshold rate. In this respect, the sales flow period is not cut short by a predetermined time period as taught in the prior art.

Figure 2:
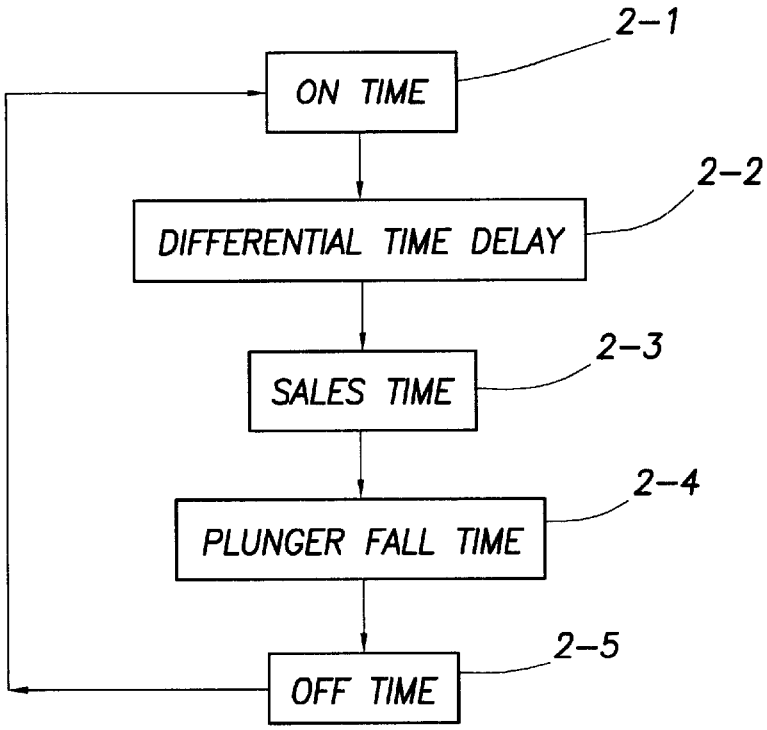
FIG. 2 is illustrates an exemplary method of the present invention.

An exemplary method of the present invention may be summarized as shown in FIG. 2. Using the plunger lift system described above, the system is in the off time mode, shown as step 2-5. W en the ON pressure differential is reached, the controller initiates the ON time mode as shown in step 2-1. During the on time mode, the controller looks for a closed contact switch such as sensing the plunger at the surface. When the closed contact switch is detected, the controller initiates the differential time delay, shown as step 2-2, to allow for removal of fluid from the tubing. At the expiration of the differential time delay, the controller initiates the sales time for production gas flow, shown as step 2-3. Th sales time ends when the OFF pressure differential is met. At the beginning of the off-cycle, the controller initiates the plunger fall time to give the plunger sufficient time to all back down the wellbore as show in step 2-4. At the end of plunger fall time, the system enters the off time mode as shown in step 2-5. During off time mode, the controller makes adjustments to the operating parameters to optimize the well. If the ON pressure differential is adjusted, the cycle will start over when the new ON pressure differential is met.

Gas Lift System

Figure 3:
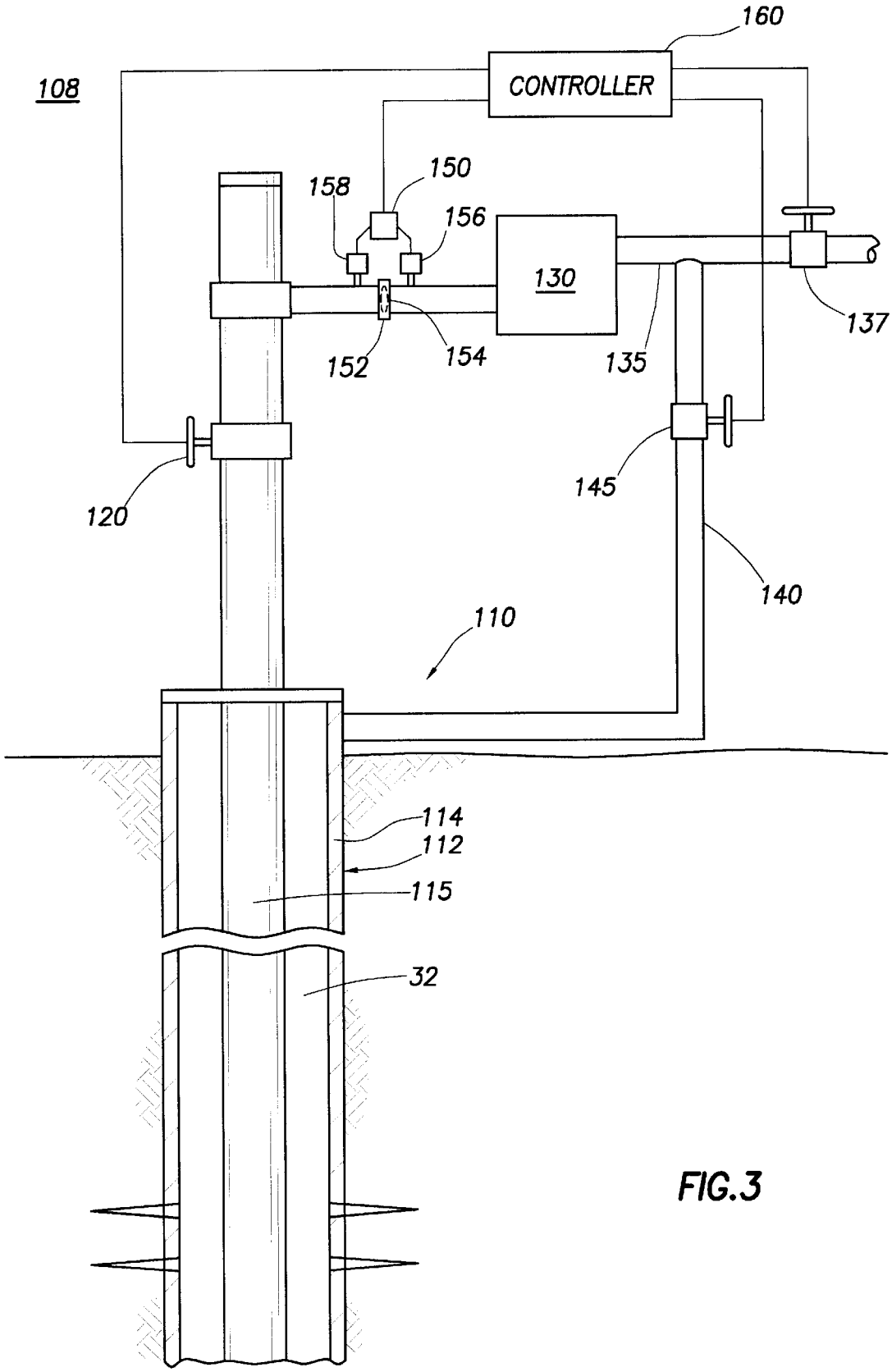
FIG. 3 is a schematic drawing of a gas lift system.

The aspects of the present invention are also applicable to optimizing a gas lift system 108. As shown in FIG. 3, the gas lift well 110 includes a wellbore 112 which is lined with casing 114 and a string of production tubing 115 co-axially disposed therein. The production tubing 115 extends from the bottom to the surface of the well 110, where a shut-in valve 120 is located to close the tubing 115 and shut-in the well 110. A delivery line 135 is disposed at the other end of the shut-in valve 120 and includes a compressor 130 and a sales valve 137 to close the delivery line 135. A gas line 140 having a bypass valve 145 is disposed between the compressor 130 and the sales valve 137 to inject compressed gas into the wellbore 112.

A pressure differential transducer 150 and a plate 152 having an orifice 154 therein is disposed between the shut-in valve 120 and the compressor 130. Pressure sensors 156, 158 are placed in front of and behind the orifice 154 to measure the gas flow, or pressure differential, across the orifice 154. The pressure differential transducer 150 sends the measured pressure differential to a controller 160 for processing and executing in accordance with the aspects of the present invention.

In operation, the gas lift system 108 is in the on-cycle with the shut-in valve 120 and the sales valve 137 opened and the bypass valve 145 closed to gas flow. The pressure differential transducer 150 receives the readings from the sensors 156, 158 and calculates the pressure differential across the orifice 154. The controller 150 compares the measured pressure differential to a predetermined "OFF" pressure differential.

When the measured pressure differential drops to or below the OFF pressure differential, indicating that the production gas flow rate is slow, the controller 160 will initiate the off-cycle by closing the sales valve 137 and opening the bypass valve 145. Compressed gas leaving the compressor 130 enters the bypass line 140 and is delivered back to the wellbore 112 thereby causing the casing pressure to increase. As the casing pressure increases, the gas flow across the orifice 154 will also increase. It must be noted that although the term "off-cycle" is used, the well 110 is not shut-in because the production is recycled through the compressor 130 and back to the well 110.

When a predetermined "ON" pressure differential is detected across the orifice 154, the controller 160 initiates the on-cycle by closing the bypass valve 145 and opening the sales valve 137. Generally, the ON pressure differential selected is higher than the OFF pressure differential to allow for a period of production gas flow. The on-cycle begins with a period of mandatory flow time, or differential time delay, during which the pressure differential transducer reading is not recognized by the controller 160. At the expiration of the mandatory flow period, the controller 160 initiates the sales time period. During this time, the controller 160 will look for the measured pressure differential to drop to or below the OFF pressure differential and start the cycle over.

If the system 108 successfully completes a cycle, the controller 160 will automatically adjust the parameters of the system 108 to optimize the production. Generally, the controller 160 will adjust the parameters to achieve more sales time. For example, after a successful cycle, the predetermined ON pressure differential may be decreased by about 10%. As a result, less time is required for the system 108 to develop the reduced ON pressure differential and begin the on-cycle. Alternatively, the differential time delay may be increased by about 10% to guarantee more sales flow. In addition, the predetermined OFF pressure differential may be lowered by about 10%. This adjustment will allow the production gas flow for a longer period of time before the controller 160 initiates the off-cycle.

The controller 160 may also make adjustments to the parameters if the OFF pressure differential is met at the expiration of the differential time delay. This situation is not desirable because the controller 160 immediately initiates the off-cycle at the expiration of the differential time delay and sales time is truncated. To avoid this situation, the controller 160 decreases the differential time delay by about 10% so that the controller 160 may initiate the sales time sooner.

The Controller

The aspects of the present invention can be executed in response to instructions of a computer program executed by a microprocessor or computer controller. For example, a computer program product that runs on a conventional computer system comprising a central processing unit ("CPU") interconnected to a memory system with peripheral control components. The operating instructions for executing the optimization method of the present invention may be stored on a computer readable medium, and later retrieved and executed by a processing device. The computer program code may be written in any conventional computer readable programming language such as for example C, C++, or Pascal. If the entered code text is in a high level language, the code is compiled, and the resultant compiler code is then linked with an object code of precompiled windows library routines. To execute the linked compiled object code, the system user invokes the object code, causing the computer system to load the code in memory, from which the CPU reads and executes the code to perform the tasks identified in the program.

Figure 4:
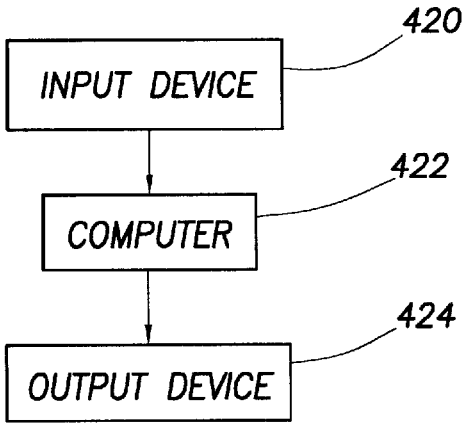
FIG. 4 is illustrates an exemplary hardware configuration of the present invention.

An exemplary hardware configuration for implementing the present invention is illustrated in FIG. 4. Input device 420 may be used to receive and/or accept input representing basic physical characteristics of an artificial lift system and a well. These basic characteristics may be casing pressure, tubing pressure, sales line pressure, etc. This information is transmitted to a processing device, which is shown as computer 422 in the exemplary hardware configuration. Computer 422 processes the input information according to the programmed code to determine the operational parameters of the artificial lift system. Upon completing the data processing, computer 422 outputs the resulting information to output device 424. The output device may be configured to operate as a controller for the artificial lift system, which could then alter an operational parameter of the artificial lift system in response to analysis of the system. For example, if analysis of the artificial lift system determines that a full cycle was completed successfully, then the controller may be configured to adjust an operational parameter for a subsequent cycle in order to optimize well production. Alternatively, the output device may operate to display the processing results to the user. Common output devices used with computers that may be suitable for use with the present invention include monitors, digital displays, and printing devices.

While the foregoing is directed to embodiments of the present invention, other and further embodiments of the invention may be devised without departing from the basic scope thereof, and the scope thereof is determined by the claims that follow.

What is claimed is:

1. A method of operating a well having an on time and an off time cycle, comprising:

measuring a first pressure differential;

comparing the first pressure differential to a first stored value;

opening a valve between a tubing and a sales line when the first pressure differential is at least the same as the first stored value, the valve permitting pressurized gas to flow from the tubing into the sales line;

sensing a completion of a portion of the cycle;

measuring a second pressure differential across two points in the sales line;

comparing the second pressure differential to a second stored value;

closing the valve when the second pressure differential is less than or equal to the second stored value; and adjusting one or more of the stored values.

2. The method of claim 1, herein the first pressure differential is measured between a casing pressure an a sales line pressure.

3. The method of claim 2, wherein the one or more stored values are adjusted prior to beginning a subsequent cycle.

4. The method of claim 3, wherein the portion of the cycle is the arrival of a plunger at a predetermined location in the tubing.

5. The method of claim 1, further comprising maintaining the valve open for a first time period after sensing the completion of a portion of the cycle.

6. The method of claim 5, further comprising adjusting the first time period for which the valve is maintained open nor to beginning a subsequent cycle.

7. The method of claim 1, further comprising maintaining the valve closed for a first time period after closing the valve.

8. The method of claim 7, further comprising maintaining the valve open for a second time period after sensing the completion of a portion of the cycle.

9. The method of claim 1, wherein the portion of the cycle is the arrival of a plunger at a predetermined location in the tubing.

10. The method of claim 9, wherein the arrival of the plunger is sensed within a first time period.

11. The method of claim 10, wherein the arrival of the plunger is sensed within a second time period if the arrival of the plunger was not sensed in the first time period.

12. The method of claim 11, wherein adjusting one or more of the stored values comprises increasing the first stored value if the arrival of the plunger was not sensed within the second time period.

13. The method of claim 11, wherein adjusting one or more of the stored values comprises increasing the second stored value if the arrival of the plunger was not sensed within the second time period.

14. The method of claim 1, wherein adjusting one or more of the stored values comprises decreasing the first stored value.

15. The method of claim 14, further comprising decreasing the second stored value.

16. The method of claim 15, further comprising maintaining the valve open for a first time period after sensing the arrival of the plunger.

17. The method of claim 16, further comprising adjusting the first time period for which the valve remains open prior to beginning a subsequent cycle.

18. A method of optimizing an artificial lift well operating on a cycle, comprising:

opening a sales valve disposed on a delivery line for a gas flow;

closing a bypass valve disposed on a bypass line leading from the delivery line to the well;

measuring a first pressure differential across two points upstream from the sales valve on the delivery line;

comparing the first pressure differential to a first stored value;

closing the sales valve when the first pressure differential is less than or equal to the first stored value;

opening a bypass valve to deliver the gas flow to the well;

measuring a second pressure differential across the two points;

comparing the second pressure differential to a second stored value;

closing the bypass valve when the second pressure differential is at least the same as the second stored value;

opening the sales valve;

adjusting one or more of the stored values prior to beginning the subsequent cycle.

19. The method of claim 10, further comprising maintaining the sales valve open for a first time period after closing the bypass valve.

20. The method of claim 19, further comprising adjusting the first time period.

21. The method of claim 18, further comprising maintaining the bypass valve open for a first time period after closing the sales valve.

22. The method of claim 21, further comprising adjusting the first time period.

23. The method of claim 18, further comprising a compressor disposed downstream from the two points and upstream from the sales valve.

24. The method of claim 23, wherein the bypass line connects to the delivery line at a location between the compressor and the sales valve.

25. The method of claim 24, further comprising maintaining the sales valve open for a first time period after closing the bypass valve.

26. The method of claim 25, further comprising maintaining the bypass valve open for a second time period time after closing the sales valve.

27. The method of claim 26, further comprising adjusting the first time period.

28. A method of operating an artificial lift system, comprising:

measuring a first pressure at a first location in the system;

measuring a second pressure at a second location in the system;

calculating a first pressure differential between the first pressure and the second pressure;

comparing the first pressure differential to a first stored value;

opening a valve between a tubing and a delivery line when the first pressure differential is at least the same as the first stored value; the valve permitting pressurized gas to flow from the tubing into the delivery line;

measuring a second pressure differential across two points in the delivery line;

comparing the second pressure differential to a second stored value;

closing the valve when the second pressure differential is less than or equal to the second stored value; and adjusting one or more of the stored values prior to beginning the subsequent cycle.

29. The method of claim 28, further comprising detecting a closed contact switch.

30. The method of claim 29, wherein detecting a closed contact switch comprises detecting a plunger arrival.

31. The method of claim 29, wherein detecting a closed contact switch comprises detecting a decrease in a casing pressure.

32. The method of claim 28, wherein the closed contact switch is detected within a first time period.

33. The method of claim 32, wherein the closed contact switch is detected within a second time period if the close contact switch was not detected within the first time period.

34. The method of claim 33, wherein detecting the closed contact switch comprises detecting a plunger arrival.

35. The method of claim 34, wherein a vent valve is opened during the second time period.

36. The method of claim 28, wherein the first location is selected from the group consisting of a casing, the tubing, and the delivery line.

37. The method of claim 36, herein the second location is selected from the remaining locations in the group.

38. The method of claim 28 further comprising maintaining the valve open for a first time period after sensing the closed contact switch.

39. The method of claim 38, further comprising adjusting the first time period for which the valve is maintained open prior to beginning a subsequent cycle.

40. The method of claim 28, further comprising maintaining the valve closed for a first time period after closing the valve.

41. The method of claim 40, further comprising maintaining the valve open for a second time period after sensing the closed contact switch.

42. A computer readable medium containing instructions which, when executed, performs an operation for well production processes, the operation comprising:

measuring a first press re differential between a casing pressure and a sales line pressure;

comparing the first pressure differential to a first stored value;

opening a valve between a tubing and a sales line when the first pressure differential is at least the same as the first stored value, the valve permitting pressurized gas to flow from the tubing into the sales line;

detecting the arrival of plunger at a predetermined location in the tubing;

measuring a second pressure differential across two points in the sales line;

comparing the second pressure differential to a second stored value;

closing the valve when he second pressure differential is less than or equal to the second stored value; and adjusting one or more of the stored values prior to beginning a subsequent cycle.

43. The computer readable medium of claim 42, further comprising maintaining the valve open for a first time period after detecting the arrival of the plunger.

44. The computer readable medium of claim 43, further comprising adjusting the first time period for which the valve is maintained open prior to beginning a subsequent cycle.

45. The computer readable medium of claim 42, further comprising maintaining the valve closed for a first time period after closing the valve.

46. The computer readable medium of claim 45, further comprising maintaining the valve open for a second time period after detecting the arrival of the plunger.

47. The computer readable medium of claim 42, wherein the arrival of the plunger is detected within a first time period.

48. The computer readable medium of claim 47, wherein the arrival of the plunger is detected within a second time period if the arrival of the plunger was not detected in the first time period.

49. The computer readable medium of claim 48, wherein adjusting one or more of the stored values comprises increasing the first stored value if the arrival of the plunger was not detected within the second time period.

50. The computer readable medium of claim 48, wherein adjusting one or more of the stored values comprises increasing the second stored value if the arrival of the plunger was not detected within the second time period.

51. An automated method of operating a well having an on time and an off time, comprising:

measuring a first press re differential between a casing pressure and a sales line pressure;

comparing the first pre sure differential;

opening a valve between a tubing and a sales line when the first pressure differential is at least the same as the first stored value, the valve permitting pressurized gas to flow from the tubing into the sales line;

sensing a completion a portion of the cycle;

maintaining the valve closed for a first time period after closing the valve;

maintaining the valve pen for a second time period after sensing the completion of a portion of the cycle;

measuring a second pressure differential;

comparing the second pressure differential to a second stored value;

closing the valve when the second pressure differential is less than or equal to the second stored value; and adjusting one or more of the stored values.

52. A method of operating a well having an on time and an off time cycle, comprising:

measuring a first pressure differential;

comparing the first pressure differential to a first stored value;

opening a valve between a tubing and a sales line when the first pressure differential is at least the same as the first stored value, the valve permitting pressurized gas to flow from the tubing into the sales line;

measuring a second pressure differential;

comparing the second pressure differential to a second stored value;

closing the valve when the second pressure differential is less than or equal to the second stored value; and adjusting one or more of the stored values when a completion of the cycle is detected.

53. The method of claim 52, wherein the first pressure differential is measured between a casing pressure and a sales line pressure.

54. The method of claim 52, wherein the second pressure differential is measured across two points in the sales line.

55. The method of claim 52, wherein the first stored value is adjusted prior to beginning a subsequent cycle.

56. The method of claim 52, wherein the second stored value is adjusted prior to beginning a subsequent cycle.

57. The method of claim 52, further comprising maintaining the valve open for a first time period.

58. The method of claim 57, further comprising adjusting the first time period for which the valve is maintained open.

59. The method of claim 52, further comprising maintaining the valve closed for a first time period after closing the valve.

60. The method of claim 59, further comprising adjusting the first time period for which the valve is closed.

* * * * *

UNITED STATES PATENT AND TRADEMARK OFFICE

CERTIFICATE OF CORRECTION

PATENT NO. : 6,595,287 B2
DATED : July 22, 2003
INVENTOR(S) : Fisher

It is certified that error appears in the above-identified patent and that said Letters Patent is hereby corrected as shown below:

Column 9,
Line 63, please change “herein” to -- wherein --.

Column 10,
Line 8, please change “nor” to -- prior --.

Column 11,
Line 54, please change “close” to -- closed --.
Line 63, please change “herein” to -- wherein --.

Column 12,
Lines 13 and 63, please change “press re” to -- pressure --.
Line 28, please change “he” to -- the --.
Line 65, please change “pre sure” to -- pressure --.

Signed and Sealed this

Eleventh Day of November, 2003

JAMES E. ROGAN
*Director of the United States Patent and Trademark Office*